US006575822B2

(12) United States Patent
Lowe et al.

(10) Patent No.: US 6,575,822 B2
(45) Date of Patent: Jun. 10, 2003

(54) SANDING GLOVE

(76) Inventors: Gregory Lowe, 100-23 199th St., Hollis, NY (US) 11423; Ralph Brisard, 257-29 144th Ave., Rosedale, NY (US) 11422

( * ) Notice: Subject to any disclaimer, the term of this patent is extended or adjusted under 35 U.S.C. 154(b) by 13 days.

(21) Appl. No.: 09/883,583

(22) Filed: Jun. 18, 2001

(65) Prior Publication Data

US 2002/0193060 A1 Dec. 19, 2002

(51) Int. Cl.[7] ..... B24D 15/00

(52) U.S. Cl. ..... 451/526; 451/523; 451/538

(58) Field of Search ..... 451/526, 523, 451/538, 539; 15/227; 2/158, 160

(56) References Cited

U.S. PATENT DOCUMENTS

| | | | | | |
|---|---|---|---|---|---|
| 4,038,787 | A | * | 8/1977 | Bianchi | 51/391 |
| 5,661,853 | A | * | 9/1997 | Wilmot | 2/163 |
| 5,885,148 | A | * | 3/1999 | Vargas et al. | 451/523 |
| 2002/0009966 | A1 | * | 1/2002 | Orr | 451/523 |

FOREIGN PATENT DOCUMENTS

| | | | | |
|---|---|---|---|---|
| GB | 2143720 | * | 10/1983 | A41D/19/00 |

* cited by examiner

*Primary Examiner*—Lee Wilson
(74) *Attorney, Agent, or Firm*—Michael I. Kroll

(57) ABSTRACT

A sanding glove for treating an area of an object. The sanding glove includes a glove portion, a sanding portion releasably secured to the glove portion and a device for releasably securing the sanding portion to the glove portion. The user is able to treat a surface of an object by rubbing the sanding portion against the object. The device for releasably securing includes a plurality of recesses extending through the palm area of the glove portion and a plurality of protrusions extending from a first side of the sanding portion, the plurality of protrusions being received by respective recesses securing the sanding portion to the glove portion. Alternatively, the device for releasably securing may include a hook and loop fastener on both the glove portion and sanding portion which engage with one another. The glove portion is fabricated from a flexible material for protecting and bending with the user's hand. The sanding portion includes a semi rigid pad and a sanding area positioned on a side of the pad opposite the connection with the glove portion. The sanding portion may also include grooves extending along a width thereof for facilitating flexing of the sanding glove. The sanding glove is shaped in the form of a human hand or a mitten. The sanding area is one of a sanding, a buffing, a scruffing or a polishing material.

21 Claims, 15 Drawing Sheets

SANDING GLOVE

BACKGROUND OF THE INVENTION

1. Field of the Invention

The present invention relates generally to sanding devices and, more specifically, to a sanding glove having surface removably attached to a glove portion thereof thereby permitting sanding of a surface by hand with a sanding surface of any desired coarseness.

2. Description of the Prior Art

Numerous sanding devices have been provided in prior art. For example, U.S. Pat. No. 3,748,792 issued to Lamb; U.S. Pat. No. 3,789,555 issued to Means; and U.S. Pat. No. 5,297,366 issued to Huddleston all are illustrative of such prior art. While these units may be suitable for the particular purpose to which they address, they would not be as suitable for the purposes of the present invention as heretofore described.

U.S. Pat. No. 3,748,792

Issued: Jul. 31, 1973

Inventor: Walter M. Lamb

A sanding glove having a cloth hand covering and sandpaper fastened to one or both of the outer surfaces thereof and retained on the hand of the user by a stretchable cuff which fits around the user's wrist. The glove can be a mitt or finger glove or a finger glove with similar thumb and little finger pockets, so that the glove is usable on either hand. The mitt has sandpaper on both sides, so that it can be used on either hand.

U.S. Pat. No. 3,789,555

Issued: Feb. 5, 1974

Inventor: John R. Means

A glove, which may consist of paper, cotton twill or the like, is first impregnated with an adhesive taken from the epoxy resin class. An abrasive is then coated over the adhesive lamination on each of the opposite sides of the glove including the digital, palm and back side sections. The glove is configured so that it can be worn on both the right and left hands making the palm and digital sections reversible. Thus, all portions of the glove contain working surfaces. Opposite sides of the glove can be coated with different grades and density of abrasive, so that one side of the glove can serve as coarse and the other as fine finishing. Either side can be brought into use by simply reversing the glove from one hand to the other, to present the proper working surface. The abrasive can be applied by means of a cut-out form applied onto a pressure-sensitive surface of the glove. The abrasive can be applied to an unpoloymerized lamination of plastic material which is soaked into the surface of the glove. The abrasive surface can form a part of a liner which is slipped over the glove. The glove may either be dipped into the binder and the abrasive applied by spray coating or passing an impregnated glove through a suspension of particles.

U.S. Pat. No. 5,297,366

Issued: Mar. 29, 1994

Inventor: Michael D. Huddleston

An electric drill used with a specially designed arbor to attach a drill pad to the drill. The drill pad is removably affixed to a sanding disc or a buffing disc by hook and loop fasteners. The attached discs are firmly affixed to the drill pad for use while sanding or buffing a surface. The discs are easily pulled from the drill pad and a replacement is easily attached without needing to use tools.

SUMMARY OF THE INVENTION

The present invention relates generally to sanding devices and, more specifically, to a sanding glove having a sanding surface removably attached to a glove portion thereof thereby permitting sanding of a surface by hand with a sanding surface of any desired coarseness.

A primary object of the present invention is to provide a sanding glove that overcomes the shortcomings of the prior art devices.

Another object of the present invention is to provide a sanding glove that is able to bring precision and perfection to the task of sanding delicate products, while also protecting and releasing tension from the fingers when working.

An additional object of the present invention is to provide a sanding glove that allows a person to readily sand hard to reach areas of a surface.

A further object of the present invention is to provide a sanding glove including a sanding surface releasably secured to the glove portion of the sanding glove.

A still further object of the present invention is to provide a sanding glove wherein the sanding surface is interchangeable with other surfaces having a different level of coarseness.

A yet further object of the present invention is to provide a sanding glove having additional surfaces which may be releasably secured to the glove portion including a scruffing surface, a polishing surface and a buffing surface.

An even further object of the present invention is to provide a sanding glove which is reusable and washable.

A still further object of the present invention is to provide a sanding glove including a plurality of strategically positioned recesses having rigid walls defining the recess and the sanding surface includes a plurality of protrusions aligned with the plurality of recesses, each of the protrusions being received by a respective recess for securing the sanding surface to the glove portion.

A further object of the present invention is to provide a sanding glove that is simple and easy to use.

A still further object of the present invention is to provide a sanding glove that is economical in cost to manufacture.

Further objects of the invention will appear as the description proceeds.

A sanding glove for treating an area of an object. The sanding glove includes a glove portion, a sanding portion releasably secured to the glove portion and a device for releasably securing the sanding portion to the glove portion. The user is able to treat a surface of an object by rubbing the sanding portion against the object. The device for releasably securing includes a plurality of recesses extending through the palm area of the glove portion and a plurality of protrusions extending from a first side of the sanding portion. The plurality of protrusions are each received by respective recesses securing the sanding portion to the glove portion. Each recess preferably includes a lip reducing the circumference thereof and each protrusion preferably has an enlarged head having a circumference larger than the circumference of the lips whereby the protrusions are held within a recess by the lip. A rigid material defines a depth of each recess. A cushioning material is provided for cushioning the hand of the user. Alternatively, the device for releasably securing may include a hook and loop fastener on both the glove portion and sanding portion which engage with one another. The glove portion is fabricated from a flexible material for protecting and bending with the user's hand. The sanding portion includes a semi rigid pad and a sanding area positioned on a side of the pad opposite the connection with the glove portion. The sanding portion may also include grooves extending along a width thereof for facilitating flexing of the sanding glove. The sanding glove is shaped in the form of a human hand or a mitten. The sanding area is one of a sanding, a buffing, a scruffing or a polishing material.

To the accomplishment of the above and related objects, this invention may be embodied in the form illustrated in the accompanying drawings, attention being called to the fact, however, that the drawings are illustrative only, and that the changes may be made in the specific construction illustrated and described within the scope of the appended claims.

BRIEF DESCRIPTION OF THE DRAWINGS

Various other subjects, features and attendant advantages of the present invention will become more fully appreciated as the same becomes better understood when considered in conjunction with the accompanying drawings in which like reference characters designate the same or similar parts throughout the several views, and wherein.

DESCRIPTION OF THE REFERENCE NUMERALS

Figure 1:
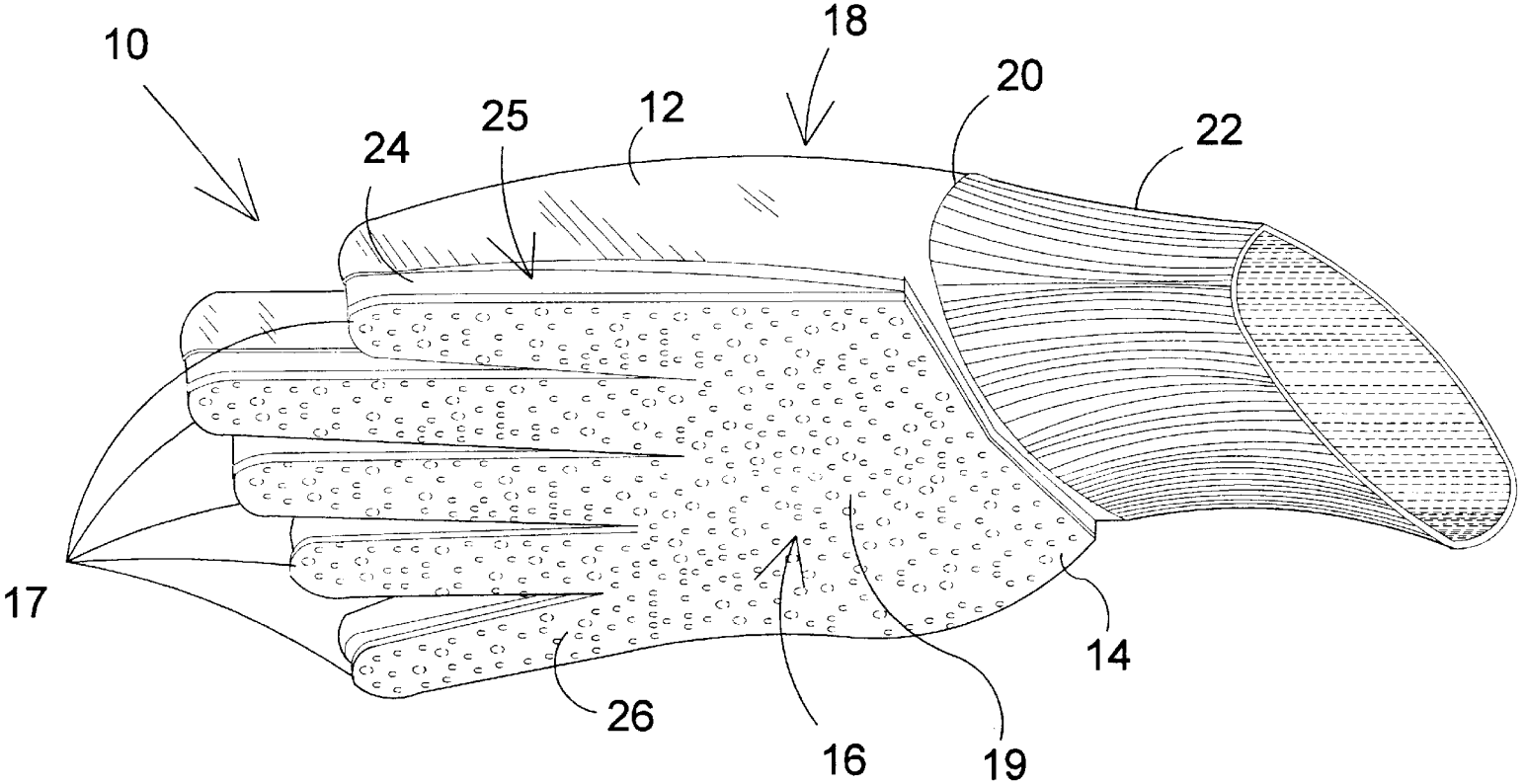
FIG. 1 is a bottom perspective view of the sanding glove of the present invention.

Turning now descriptively to the drawings, in which similar reference characters denote similar elements throughout the several views, the Figures illustrate the sanding glove of the present invention. With regard to the reference numerals used, the following numbering is used throughout the various drawing figures.

10 sanding glove of the present invention
12 glove portion
14 sanding portion
16 palm area
17 digit areas of palm section
18 back hand area
19 central area of palm section
20 base of glove portion
21 mitten shape for sanding glove
22 elastic portion
23 thumb digit of mitten shaped sanding glove
24 semi rigid pad
25 adhesive layer securing sand paper layer to semi rigid pad
26 sand paper
27 closed finger area of mitten shaped sanding glove
28 person using sandpaper glove
30 object being sanded
32 plurality of recesses
34 rigid material filling each of the plurality of recesses
36 sanding material
38 scruffing surface
40 polishing surface
42 buffing surface
44 first side of semi rigid pad
46 second side of semi rigid pad
48 protrusions extending from second side of semi rigid pad
50 lines indicating alignment of protrusions and recesses
52 arrows indicating direction of application of force on sanding pad
54 hook and loop fastener on glove portion
56 hook and loop fastener on sanding portion
58 grooves
60 pipe
62 dust being sanded from surface of pipe

DETAILED DESCRIPTION OF THE PREFERRED EMBODIMENT

Turning now descriptively to the drawings, in which similar reference characters denote similar elements throughout the several views, FIGS. 1 through 15 illustrate the sanding glove of the present invention indicated generally by the numeral 10.

Figure 12:
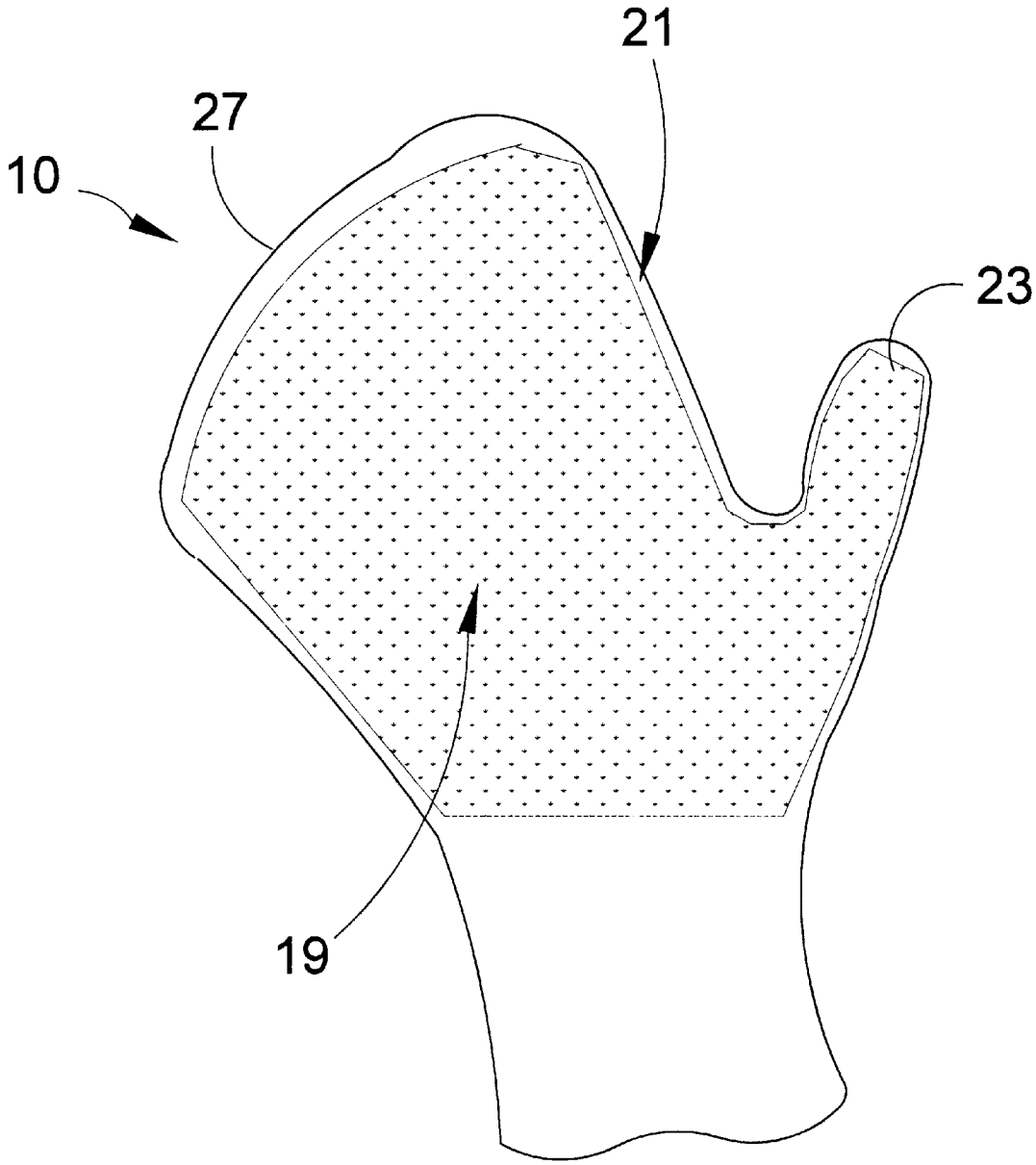
FIG. 12 is a view of the palm side of the sanding glove of the present invention in the form of a mitten.

The sanding glove 10 includes a glove portion 12 worn on a hand of a person and a sanding portion 14 releasably secured to the glove portion 12. The glove portion 12 has a palm area 16 and a back hand area 18 connected together about their peripheries leaving an opening at a base side 20 thereof for insertion of a user's hand. The palm area 16 and the back hand area 18 have a shape substantially similar to that of a conventional hand having five digit areas 17 extending from a central area 19 thereof. Alternatively, the glove portion 12 can have the shape of a mitten 21 as shown in FIG. 12. The mitten shape 21 includes a thumb digit 23 extending from a side of the central area 19 and a closed finger area 27 extending from the central area 19 on a side opposite the opening for insertion of a user's hand. The sanding glove 10 is also produced in different sizes and is thus able to fit different sized hands. An elastic band 22 is preferably secured about the base side 20 for aiding in retaining the glove portion 12 about the hand of the user. The glove portion 12 is preferably made of a flexible, waterproof material and thus conforms to the shape and bending of the user's hand while also remaining effective when wet. A plurality of recesses are strategically positioned around the periphery of the palm area 16 as will be discussed hereinafter with respect to FIGS. 3 and 6.

The sanding portion 14 includes a semi rigid pad 24 and a sand paper layer 26. The sanding portion 14 is releasably secured to the palm area 16. The sanding portion 14 is also of a size and shape substantially similar to that of the palm area thereby substantially covering the entire palm area 16 including the digit areas 17 and central area 19. The sand paper layer 26 is preferably integrally connected to a first side of the semi rigid pad 24 by an adhesive layer 25. The sandpaper layer 26 is shaped to substantially cover the semi rigid pad 24. An affixing component is applied between the semi rigid pad 24 and the sandpaper layer 26 to form the adhesive layer 25 and secure the pad 24 to the sandpaper layer 26. A second side of the semi rigid pad 24 is releasably secured to the palm area 16 of the glove portion 12. A plurality of protrusions extend from the second side of the semi rigid pad 24 as will be discussed hereinafter with respect to FIGS. 5 and 6. The plurality of protrusions are strategically positioned to mate with the plurality of recesses on the palm area 16 of the glove portion 12 to releasably secure the sanding portion 14 to the glove portion 12.

Figure 2:
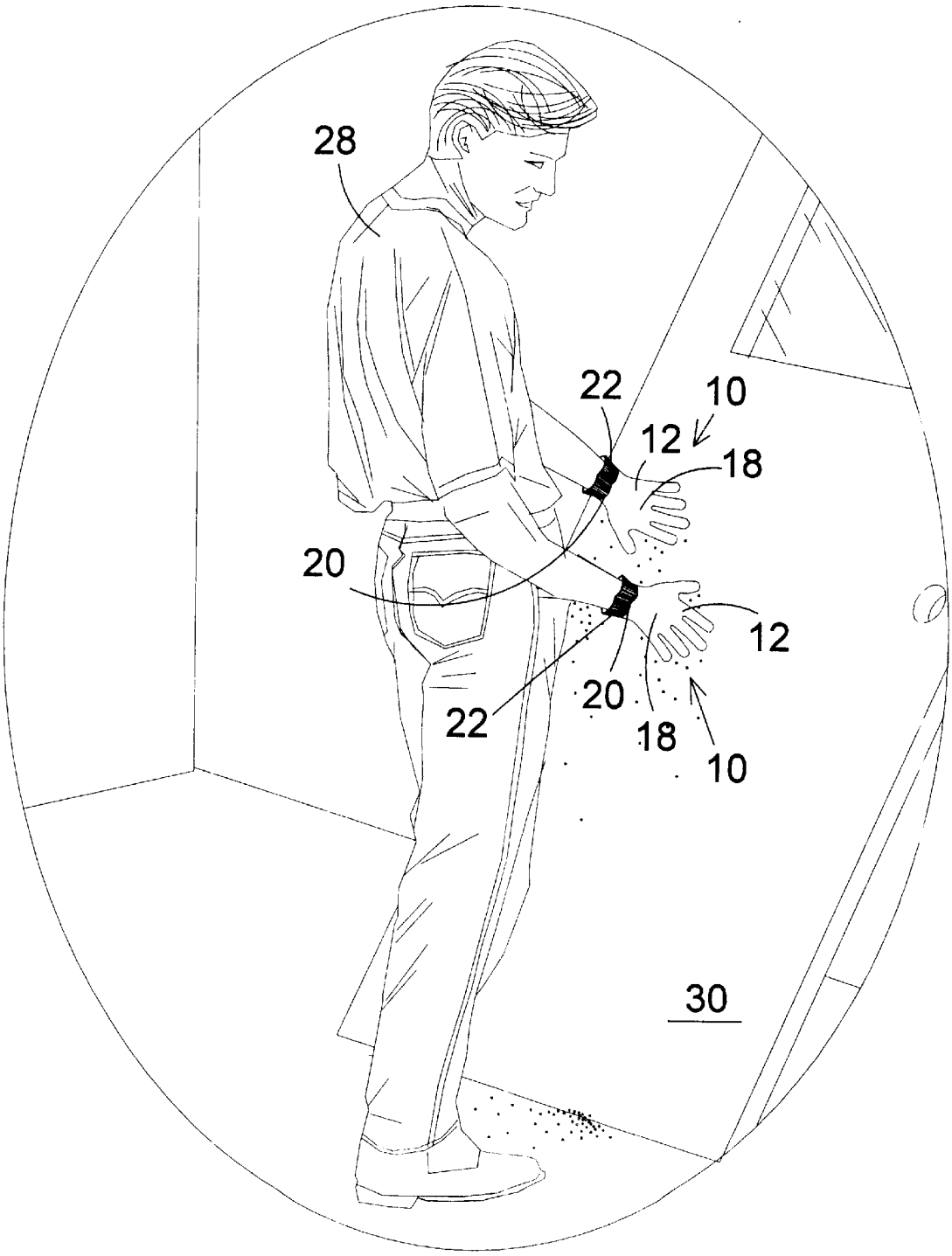
FIG. 2 is a perspective view of a person using the sanding glove of the present invention to sand a rough surface.

FIG. 2 illustrates a person 28 using the sanding glove 10 of the present invention to produce a sanded finish on an object 30. As can be seen from this figure, a person 28 had placed the sanding gloves 10 of the present invention on the hands in a manner similar to that of conventional gloves. The sanding portion 14 of the sanding glove 10 is positioned to cover the palm area 16 of the user's hand when the sanding gloves 10 are worn. The user 28 is shown sanding an object 30, e.g. a door, having rough surfaces thereon. By placing the sanding portion 14 of the sanding glove 10 against the rough surface of the object 30 desired to be sanded and rubbing the hands over the rough surface, the area over which the user moves the sanding portion 14 of the sanding glove 10 will be sanded to a desired coarseness.

Figure 3:
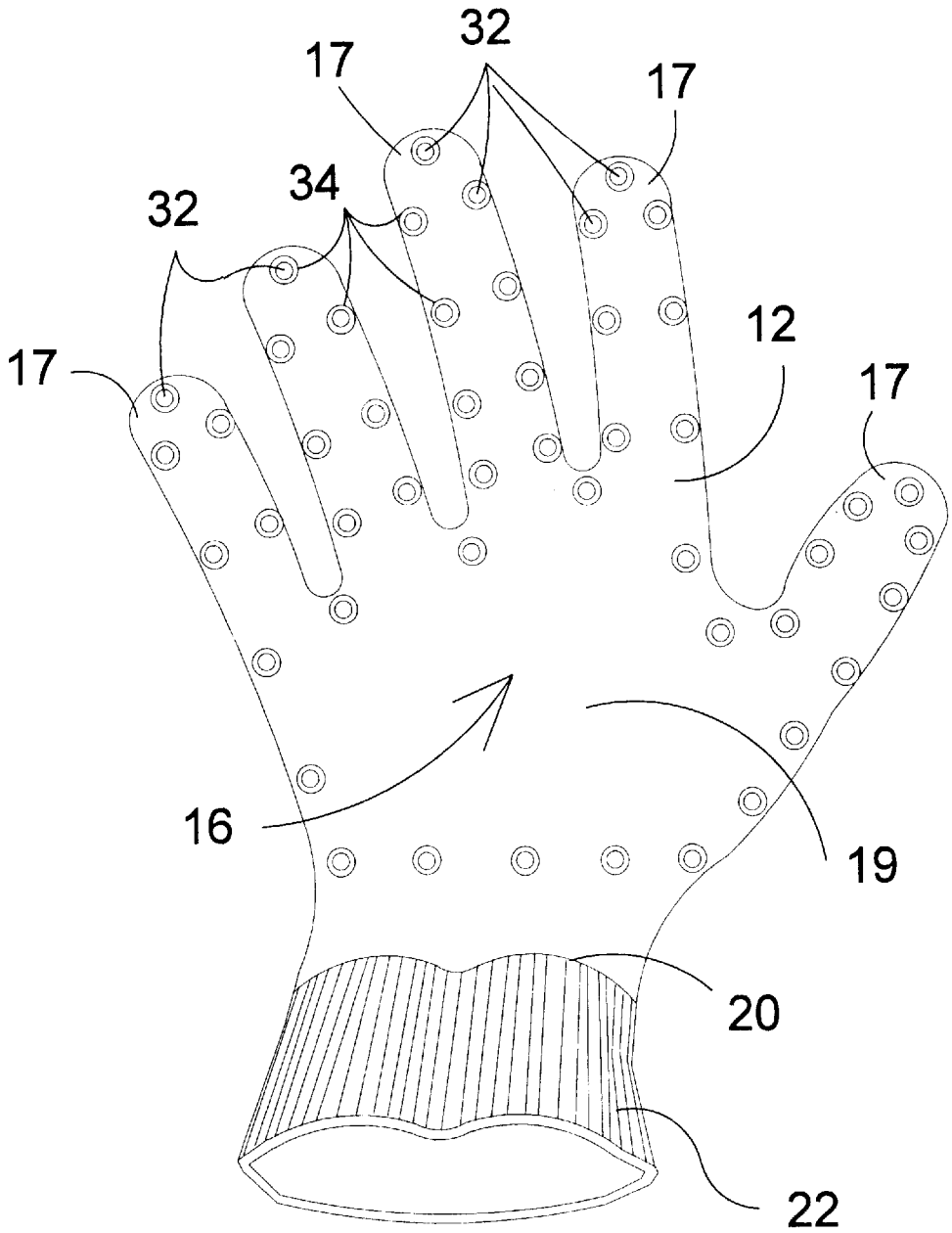
FIG. 3 is a perspective view of the palm of the glove portion of the sanding glove of the present invention.

A view of the palm area 16 of the glove portion 12 is shown in FIG. 3. From this figure it can be seen that the palm area 16 includes a central area 19 and a plurality of digit areas 17 extending from the central area 19. The digit areas 17 extend from predetermined positions of the central area 19 in order to form the shape of a normal human hand. The sanding glove 10 can be made in any desired size for receiving any size hand which may use the sanding glove 10. Extending from the base 20 of the palm area 16 is the elastic portion 22 for grasping the wrist of a user and aiding in retaining the sanding glove 10 on the hand of the user. Strategically positioned about the periphery of the palm area 16 are a plurality of recesses 32. Each of the plurality of recesses 32 are filled with a rigid material 34 in the shape of a shallow pool. The rigid material 34 defines the size of the recesses 32 and each extends into the sanding glove 10 a distance great enough to receive protrusions, extending from the semi rigid pad 24 without causing discomfort to the user when applying pressure thereto during a sanding operation. Preferably positioned on an inner side of the palm area 16 is a padded material (not shown) for providing comfort to the user during sanding and minimize discomfort to the hand and digits of the user caused by applying pressure against the rigid material 34.

Figure 4:
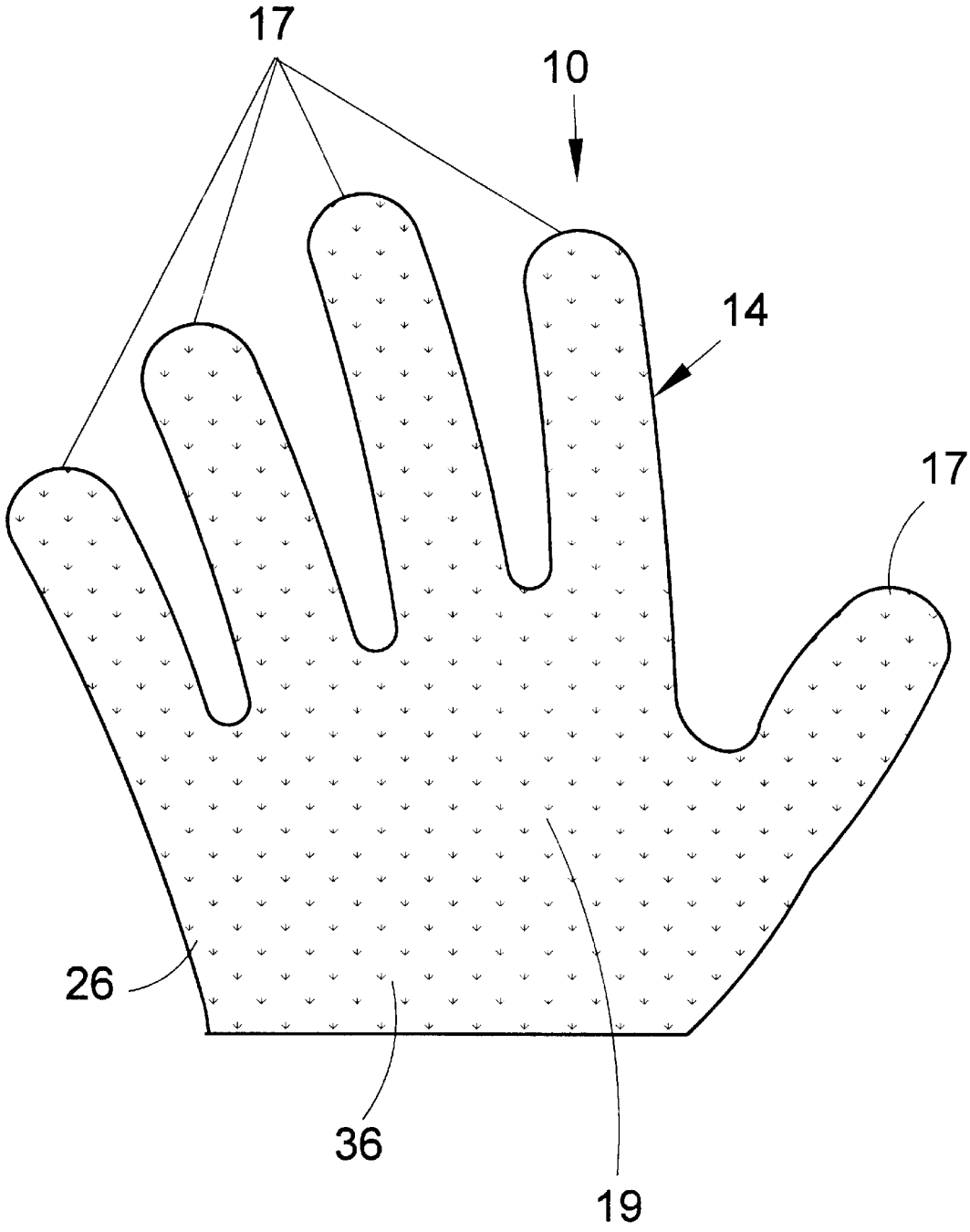
FIG. 4 is a perspective view of the palm of the sanding portion of the sanding glove of the present invention showing the sanding surface.
Figure 13:
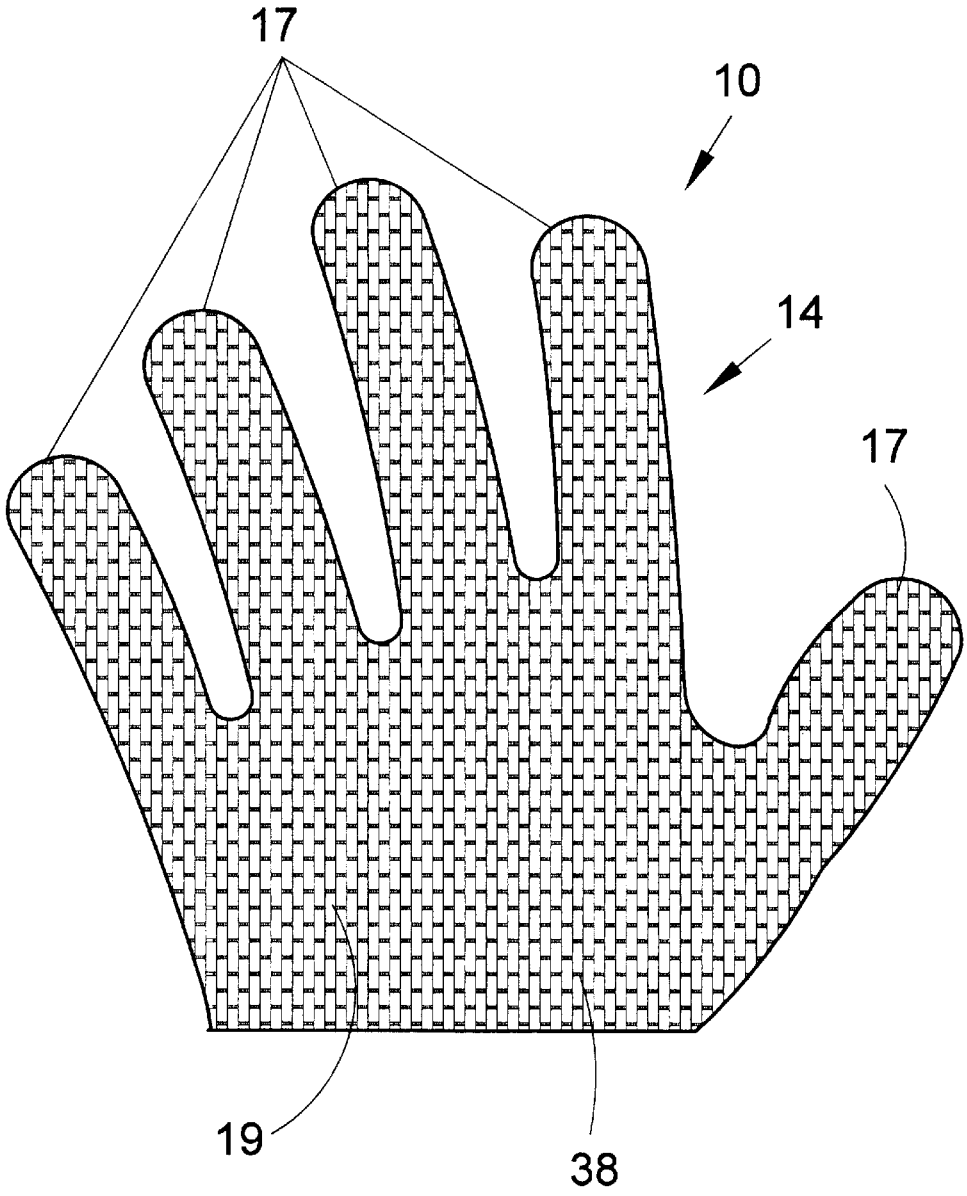
FIG. 13 is a perspective view of the palm of the sanding portion of the sanding glove of the present invention showing a scruffing surface.
Figure 14:
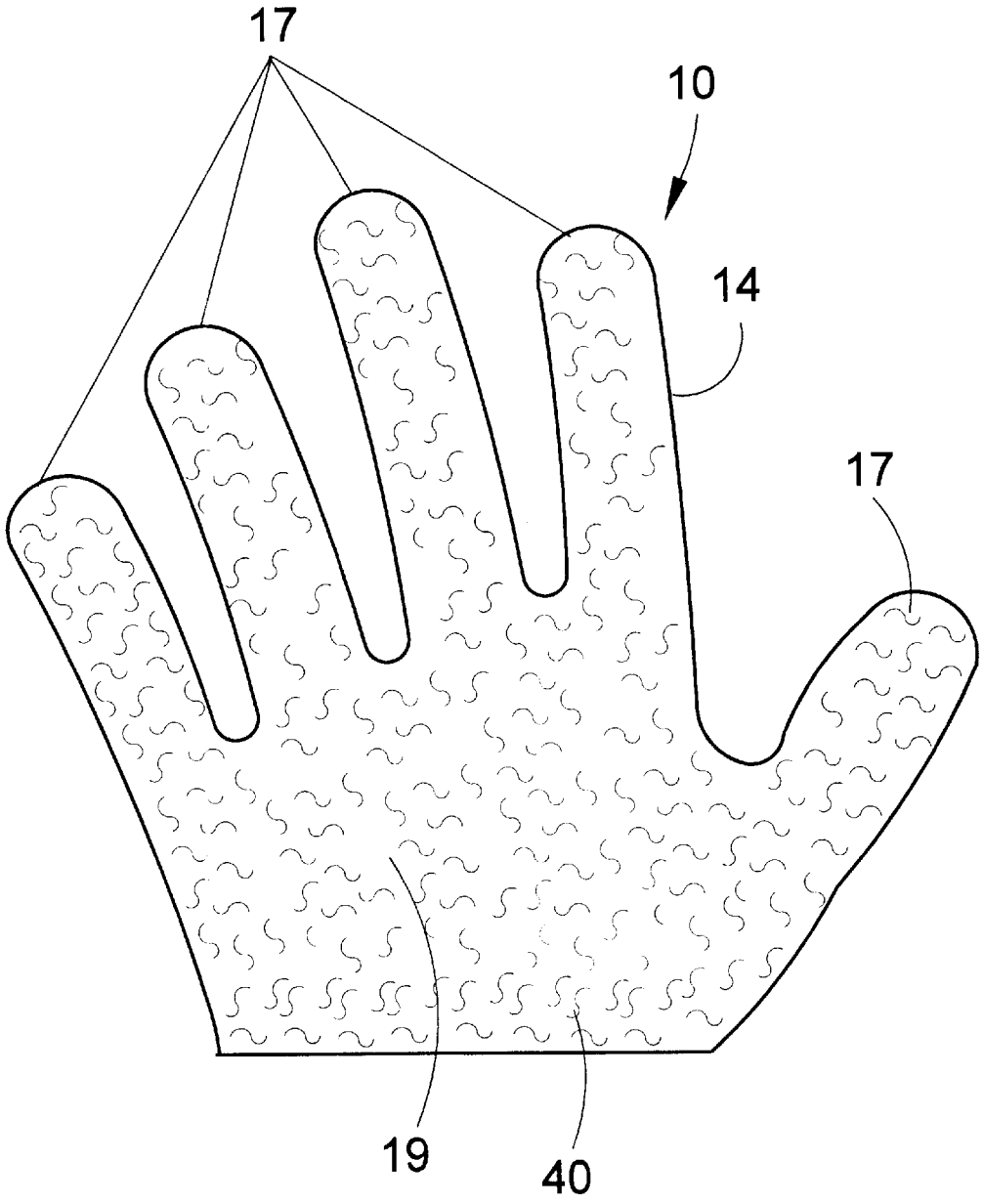
FIG. 14 a perspective view of the palm of the sanding portion of the sanding glove of the present invention showing a polishing surface.
Figure 15:
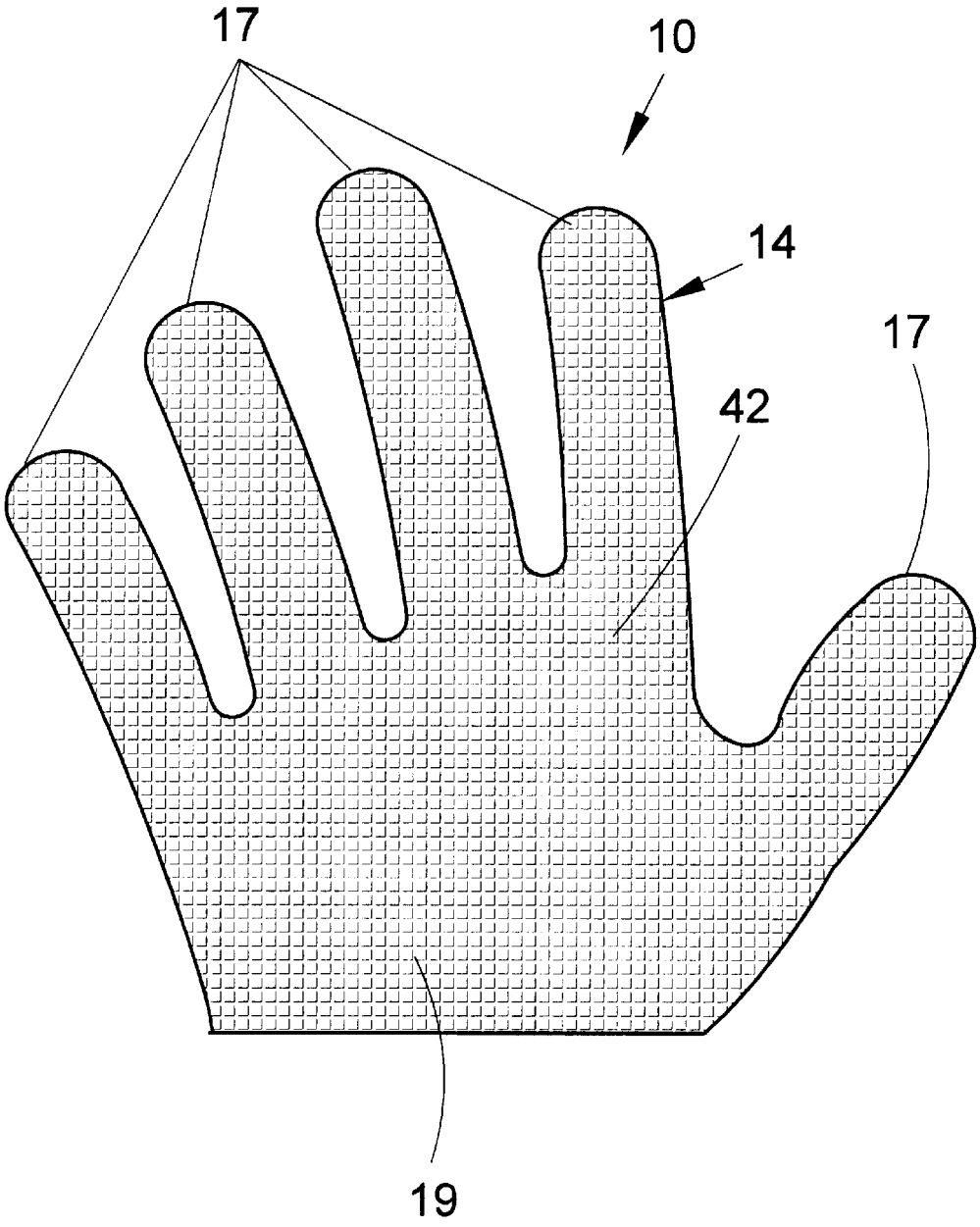
FIG. 15 a perspective view of the palm of the sanding portion of the sanding glove of the present invention showing a buffing surface.

A face side of the sanding portion 14 is shown in FIG. 4. From this figure, the sandpaper layer 26 of the sanding portion 14 is clearly seen. The sandpaper layer 26 is secured to a first side of the semi rigid pad 24. The sanding portion 14 is shaped to substantially conform with the shape of a human hand having a central area 19 and a plurality of digit areas 17 extending therefrom. The central area 19 and digit areas 17 are substantially aligned with the central area 19 and digit areas 17 of the glove portion 12. Covering the central area 19 and the digit areas 17 is a sanding material 36. The sanding material 36 is provided on the palm area of the sanding glove 10 for contacting the surface to be sanded when in use. The sanding material 36 may be of any desired fineness. A plurality of sanding portions 14 are provided with each sanding glove 10, each sanding portion 14 having a different fineness. Also provided are sanding portions 14 including a scruffing surface 38 as shown in FIG. 13, a polishing surface 40 as shown in FIG. 14 and a buffing surface 42 as shown in FIG. 15.

Figure 5:
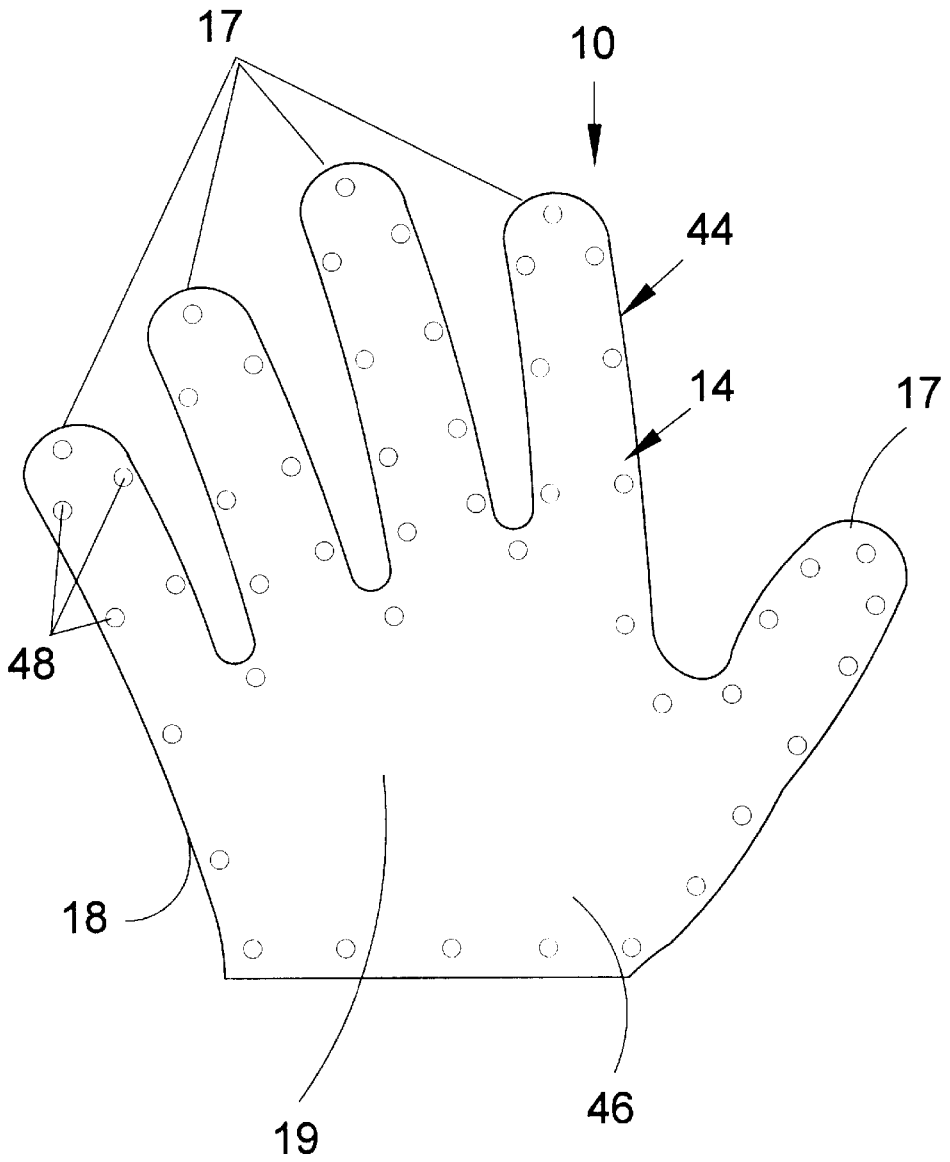
FIG. 5 is a perspective view of the back side of the sanding portion of the sanding glove of the present invention.

A back side of the sanding portion 14 is shown in FIG. 5. From this view a second side 38 of the semi rigid pad 24 is seen. The first side 44 of the semi rigid pad 24 is secured to the sandpaper layer 26 and the second side 46 is releasably secured to the palm area 16 of the glove portion 12. Similarly to the sandpaper layer 26 as discussed with specific reference to FIG. 4, the semi rigid pad 24 includes a central area 19 and a plurality of digit areas 17 extending therefrom to substantially resemble the shape of a human hand. The central area 19 and digit areas 17 are substantially aligned with the central area 19 and digit areas 17 of the glove section 12 and are sized to substantially cover the palm area 16 of the glove portion 12. Alternatively, the semi rigid pad 24 may be in the form of a mitten as illustrated in FIG. 12. In this instance, the glove portion 12 is also shaped in the form of a mitten to substantially match the shape of the sanding portion 14. Extending around a periphery of the semi rigid pad 18 are a plurality of strategically positioned protrusions 48. The protrusions 48 are each aligned to be received by a respective one of the plurality recesses 32 when the semi rigid pad 24 is secured to the glove portion 12. The height of each of the protrusions 48 is less than the depth of the rigid material 34 defining the plurality of recesses 32. Thus, the protrusions 48 can each be received by a respective recess 32 and held therein. Preferably, each of the protrusions 48 have an enlarged head and each piece of rigid material 34 includes a lip extending therearound and reducing the circumference of the recess 32. In order to connect the semi rigid pad 18 to the glove portion 12, a pressure is applied to the protrusions 48 in the direction of the recesses 32 until the protrusions each snap therein and are received and held by the rigid material 34 defining the recesses 32. When the head of each protrusion 48 is forced to pass through a lip of a respective rigid material 34, the protrusion 48 is held within the pool formed by the rigid material 34. In order to separate the semi rigid material 18 from the glove portion 12, a separation force in the direction opposite the direction of the combining force must be applied to the semi rigid pad 24. The separation force must be of a magnitude large enough to pull the head of each protrusion 48 through the lip of the respective rigid material 34.

Figure 6:
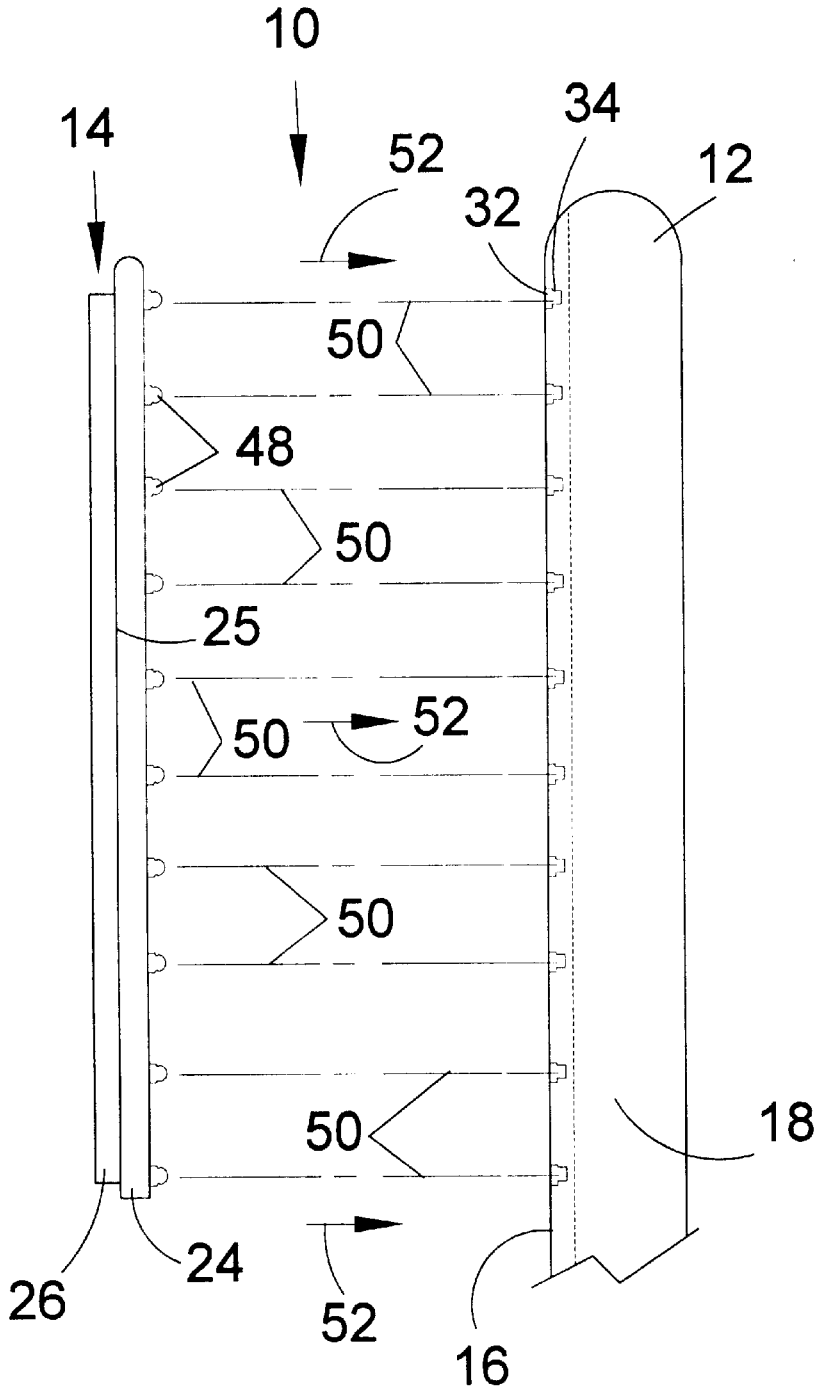
FIG. 6 is an exploded view in cross-section of the sanding glove of the present invention showing how the glove portion and sanding portion mate.

FIG. 6 is an exploded view in cross-section of the sanding glove 10 of the present invention illustrating the selective combination of the glove portion 12 and the sanding portion 14. The glove portion 12 and the sanding portion 14 are combined by applying a force to the sanding portion 14 in the direction of the palm area 16 of the glove portion 14. The user first selects a desired sanding portion 14 to use. The recesses 32 of the glove portion 12 are aligned with the protrusions 32 extending from the selected sanding portion 16 as indicated by the lines labeled with the numeral 50. Upon aligning all the protrusions 48 with a respective recess 32, the user exerts a force on the sanding portion 14 in a direction indicated by the arrows labeled with the numeral 52. When the force is applied, each of the protrusions 48 are caused to enter their respective recess 32 and be held therein by the rigid material 34.

Figure 7:
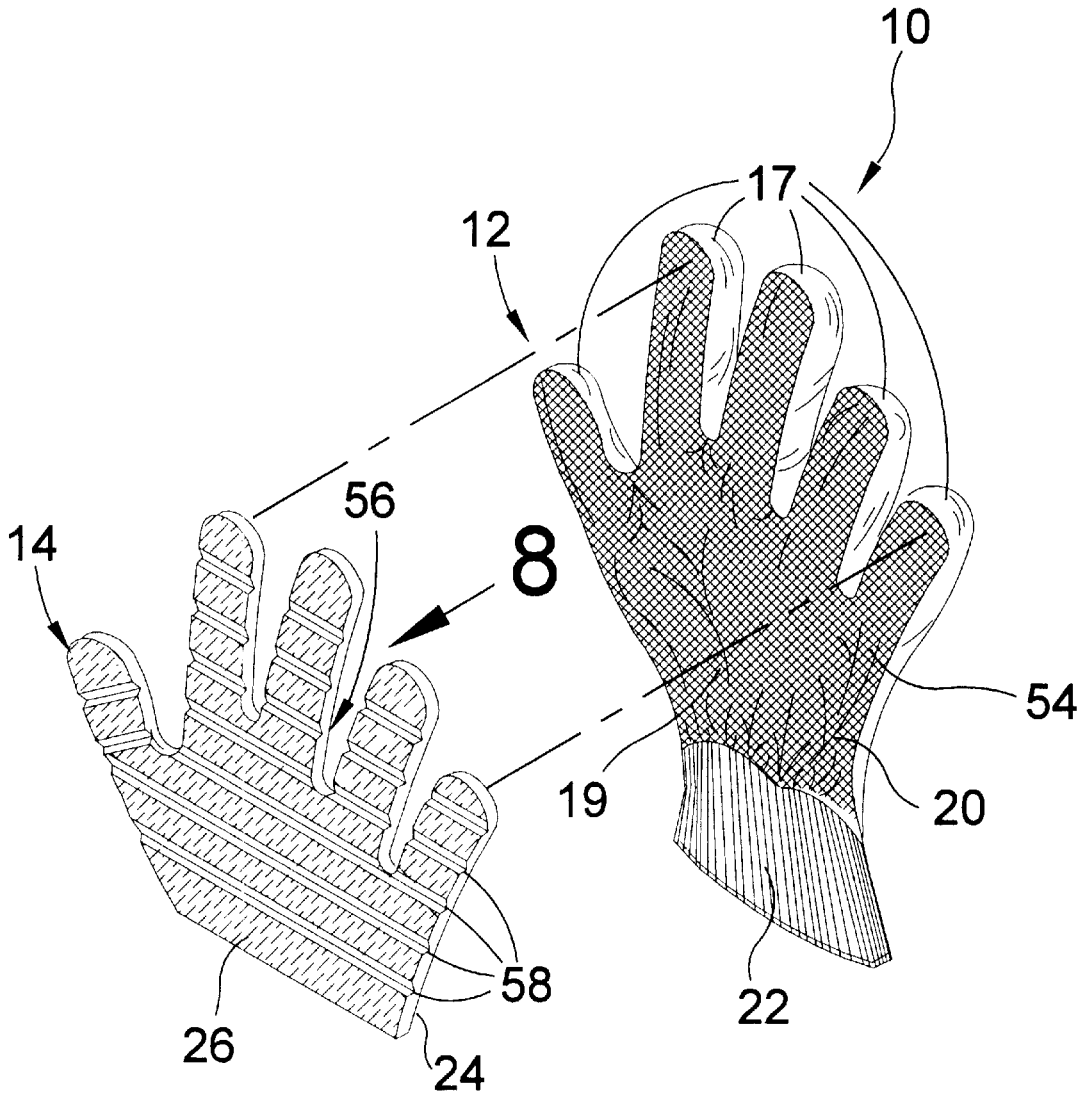
FIG. 7 is an exploded perspective view of the sanding glove of the present invention including a hook and loop fastener to secure the glove portion and the sanding portion.

FIG. 7 illustrates an exploded view of the sanding glove 10 of the present invention including a hook and loop fastener for securing the sanding portion 14 to the glove portion 12. The glove portion 12 has a palm area 16 and a back hand area 18 connected together about their peripheries leaving an opening at a base side 20 thereof for insertion of a user's hand. Both the palm area 16 and back hand area 18 of the glove portion 12 includes a central area 19 and a plurality of digit areas 17 extending from the central area 19. The digit areas 17 extend from predetermined positions of the central area 19 in order to form the shape of a normal human hand. Alternatively, the glove portion 12 can have the shape of a mitten 21 as shown in FIG. 12. The mitten shape 21 includes a thumb digit 23 extending from a side of the central area 19 and a closed finger area 27 extending from the central area 19 on a side opposite the opening for insertion of a user's hand. The sanding glove 10 can be made in any desired size for receiving any size hand which may use the sanding glove 10. An elastic band 22 is preferably secured about the base side 20 for aiding in retaining the glove portion 12 about the hand of the user. The glove portion 12 is preferably made of a flexible, waterproof material and thus conforms to the shape and bending of the user's hand while also remaining effective when wet. Positioned on the base 20 of the palm area 16 is a hook and loop fastening device 54 for engaging a hook and loop fastening device 56 on the base 20 of the glove portion 14.

The sanding portion 14 includes the semi rigid pad 24 and a sand paper layer 26. The sanding portion 14 is releasably secured to the palm area 16. The sanding portion 14 is also of a size and shape substantially similar to that of the palm area thereby substantially covering the entire palm area 16 including the digit areas 17 and central area 19. The sandpaper layer 26 is shaped to substantially cover the semi rigid pad 24. As can be seen from this figure, the sandpaper layer 26 includes a plurality of grooves 58 extending horizontally along the width thereof. The grooves 58 facilitate the flexing and bending of the sanding glove 10 by a user. A hook and loop fastener 56 covers the second side of the semi rigid pad 24 for engaging the hook and loop fastener 54 on the glove portion and releasably securing to the sanding portion 14 to the palm area 16 of the glove portion 12. The sanding portion is releasably secured to the glove portion by applying aligning the hook and loop fastener 54 on the palm area 16 of the glove portion 12 and the hook and loop fastener 56 on the base 20 of the sanding portion 14. The hook and loop fasteners 54 and 56 are then pressed together and caused to become engaged thereby securing the glove portion 12 and sanding portion 14 together.

Figure 8:
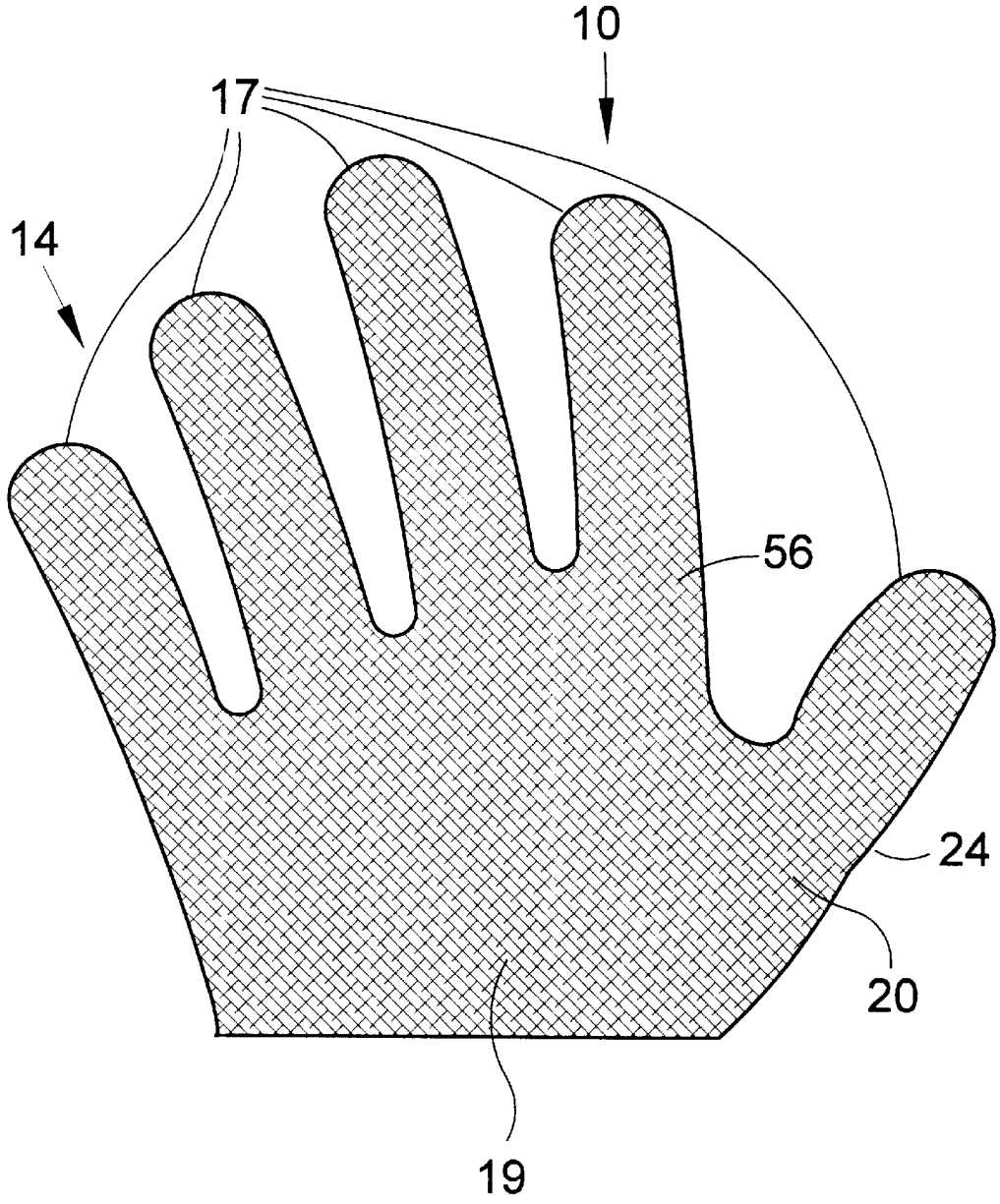
FIG. 8 is a back side view of the sanding portion of the sanding glove of the present invention shown in FIG. 7.

A view of the base 20 of the sanding portion is illustrated in FIG. 8. As can be seen from this view, the base 20 of the sanding portion 14 is covered with a hook and loop fastener 56. The hook and loop fastener 56 is provided for engaging the hook and loop fastener 54 on the palm side 16 of the glove portion 12 thereby securing the glove portion 12 and sanding portion 14 together.

Figure 9:
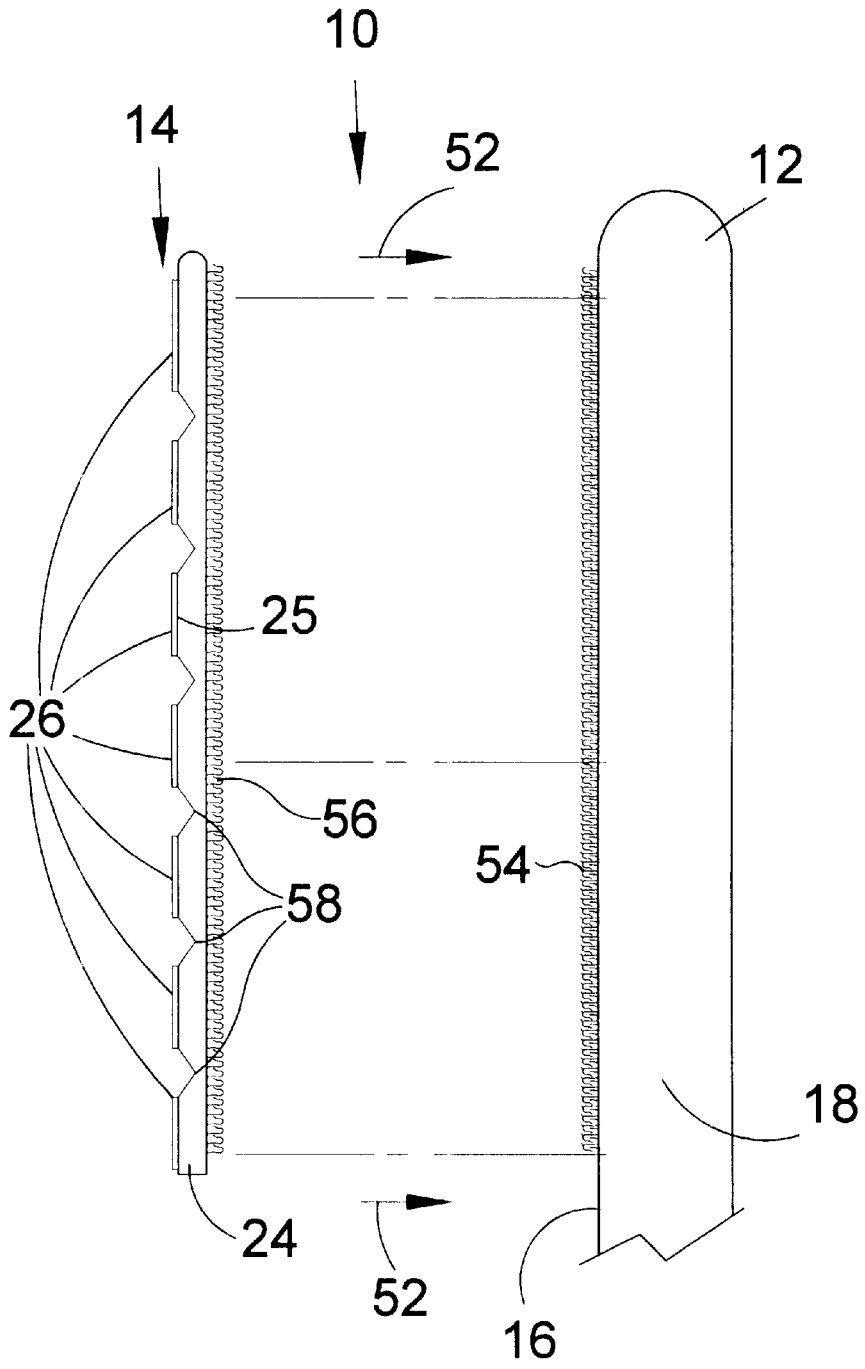
FIG. 9 is a side view of the sanding glove of the present invention as shown in FIG. 7 illustrating the connecting of the glove portion and the sanding portion.

FIG. 9 illustrates a side view of the sanding glove 10 showing the selective combination of the glove portion 12 and the sanding portion 14. The glove portion 12 and the sanding portion 14 are combined by applying a force to the sanding portion 14 in the direction of the palm area 16 of the glove portion 14 as indicated by the arrow labeled with the numeral 52. The user first selects a desired sanding portion 14 to use. The digit areas 17 of the glove portion 12 are aligned with the digit areas 17 of the selected sanding portion 16. Upon aligning the digit areas 17, the user exerts a force on the sanding portion 14 in a direction indicated by the arrows labeled with the numeral 54. When the force is applied and the sanding portion 14 contacts the glove portion 12, the hook and loop fastener 56 on the sanding portion 14 engages the hook and loop fastener 54 on the glove portion 12 thereby securing the glove portion 12 and sanding portion 14 together. The glove portion 12 and sanding portion 14 are separated by applying a force in a direction opposite the force used to secure the glove portion 12 and sanding portion 14 together thereby pulling the glove portion 12 and sanding portion 14 apart.

Figure 10:
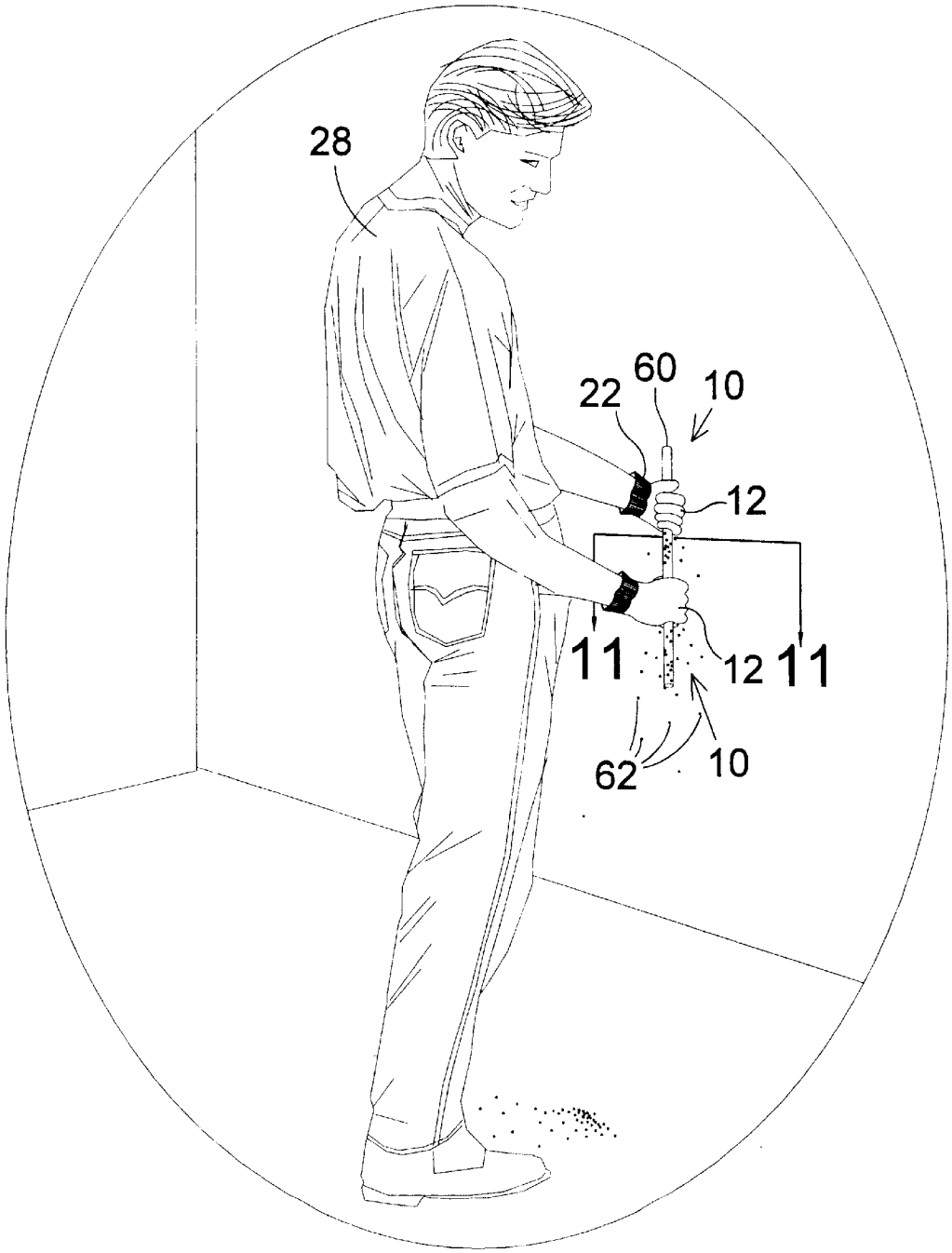
FIG. 10 is a perspective view of a person using the sanding glove of the present invention to sand a pipe.

FIG. 10 illustrates a person 28 using the sanding glove 10 of the present invention to produce a sanded finish on as piece of pipe 60. As can be seen from this figure, a person 28 had placed the sanding gloves 10 of the present invention on the hands in a manner similar to that of conventional gloves. The sanding portion 14 of the sanding glove 10 is positioned to cover the palm area 16 of the user's hand when the sanding gloves 10 are worn. The user 28 then grasps the pipe 60 with the hands placing the sanding portion 14 of the sanding gloves 10 against the coarse surface of the pipe 60 to be sanded. The user 28 then rubs the pipe 60 with the sanding portion 14 of the sanding glove 10 causing the surface of the pipe 60 to be sanded thereby removing the rough surfaces thereon. By placing the sanding portion 14 of the sanding glove 10 against the rough surface of the pipe 60 desired to be sanded and rubbing the hands over the rough surface, the area over which the user moves the sanding portion 14 of the sanding glove 10 will be sanded to a desired coarseness. Sanded particles 62 which are removed from the pipe 60 during sanding are shown falling off of the pipe 60. The user 28 continues to rub the sanding portion 14 across the surface of the pipe 60 until the pipe 60 is sanded to a desired fineness. The grooves 58 on the sanding portion 14 allows the user 28 to more easily bend the sanding glove 10 to conform to the shape of the pipe 60 and thereby facilitates the sanding of the pipe 60.

Figure 11:
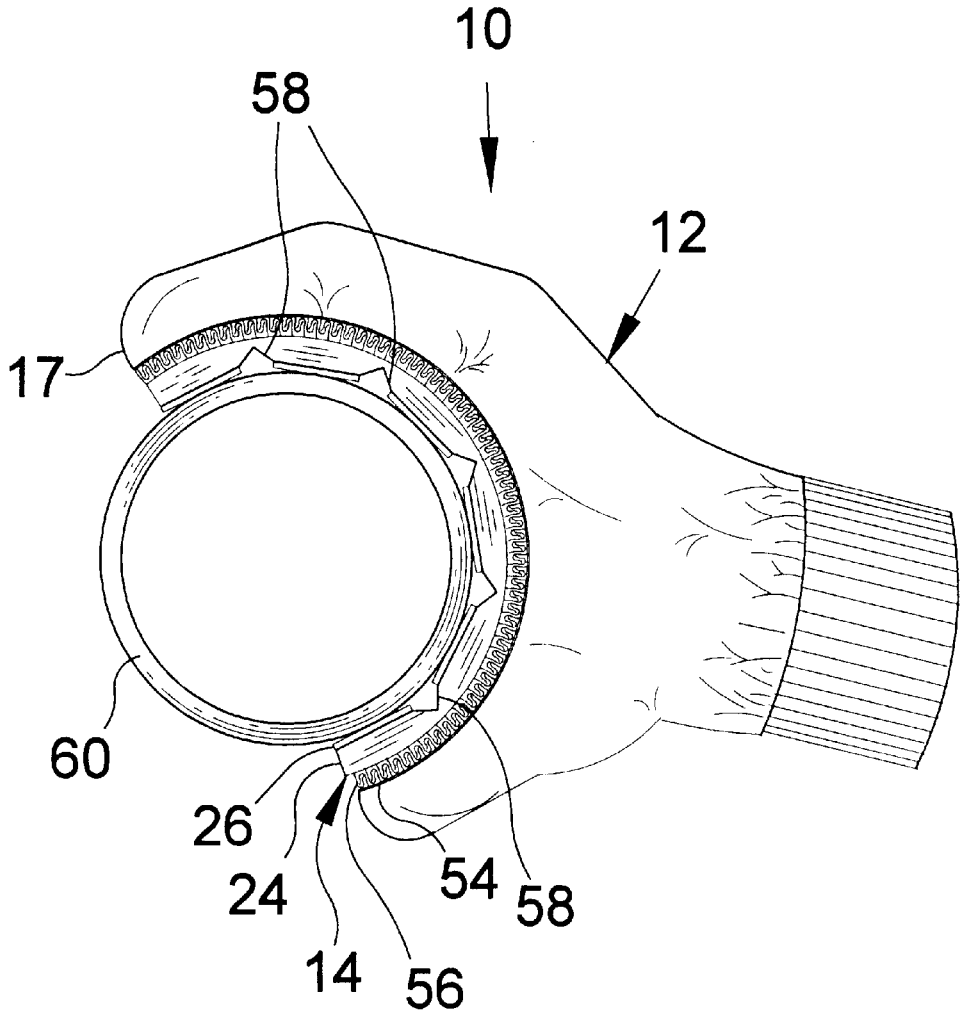
FIG. 11 is a cross-sectional view of the sanding glove of the present invention being used for sanding a pipe taken along the line 11—11 of FIG. 10.

A cross-sectional view of the sanding glove 10 being used to sand the pipe 60 is shown in FIG. 11 taken in the direction of the line labeled 11—11 in FIG. 10. As can be seen from this view, the hook and loop fastener 54 of the glove portion 12 is engaged with the hook and loop fastener 56 on the sanding portion 14 thereby securing the sanding portion to the glove portion 12. The sanding glove 10 is flexed by the user and caused to bend at the grooves 58 to conform with the shape of the pipe 60. The sandpaper portion 26 of the sanding portion 14 is positioned against the surface of the pipe 60. When the user slides the glove 10 along the surface of the pipe 60, the sandpaper 26 is caused to rub against the surface of the pipe 60 causing the area of the pipe 60 being rubbed by the sandpaper 26 to be sanded. The user continues to rub the surface of the pipe 60 until the pipe is of a desired coarseness.

The operation of the sanding glove 10 of the present invention will now be described with specific reference to the drawings. In operation, the sanding glove 10 is first assembled by releasably securing the preferred sanding portion 14 to the glove portion 12. The user must first select a desired sanding portion 14 to use. The sanding portions 14 include sanding material having numerous different levels of fineness, a polishing material, a scruffing material and a buffing material. The type of sanding portion to be used depends upon the type of job to be performed. Upon selecting a preferred sanding portion 14, the sanding portion must be releasably secured to the glove portion 12 of the sanding glove 10.

In order to secure the sanding portion 14 to the glove portion 12, the recesses 32 on the palm area 16 of the glove portion 12 are aligned with the protrusions 32 extending from the semi rigid pad 24 of the selected sanding portion 14 as indicated by the lines labeled with the numeral 50 in FIG. 6. Upon aligning all the protrusions 48 with a respective recess 32, the user exerts a force on the sanding portion 14 towards the respective recesses 32. When the force of a large enough magnitude is applied, each of the protrusions 48 are caused to press against a lip made of the rigid material 34 surrounding each recess 32. As the force is continually applied, the enlarged head section of the protrusion will be caused to pass through the lip and enter their respective recess 32. The decreased circumference of the recess 32 due to the lip will cause the protrusion as 48 to be held within the respective pool formed by the rigid material 34. The sanding portion 14 is now releasably secured tot he glove portion 12 and the sanding glove is ready for use. If the user is performing the sanding, polishing, scruffing or buffing with both hands, then the above will be performed with a glove for covering the opposite hand. The securing together of the glove portion 12 and the sanding portion 16 will substantially prevent the dislodging of the glove portion 12 and sanding portion 16 during the sanding operation.

At this point, the user will select the object to be sanded, polished, buffed or scruffed and place it in the proper position to perform the task. The user will now insert one hand through the base of the sanding glove 10 to which the sanding portion 14 was releasably secured. The other hand of the user is then inserted to the sanding glove 10 for the opposite hand. The user now grasps the object to be sanded, polished, buffed or scruffed and applies pressure to the area desired to be sanded, polished, buffed or scruffed with the sanding areas of the sanding gloves 10. The user will rub the sanding areas against the object all over the desired working areas until the working area is at a desired smoothness.

Once completed, the sanding portion 14 may be removed from the glove portion 12 by applying a force in a direction opposite to that used to secure the sanding portion 14 to the glove portion 12. The sanding portion 14 can be removed in this manner should a new sanding portion be needed to complete the task. A new sanding portion is generally needed should the surface of the sanding area be worn down. Alternatively, the sanding portion may be replaced with a sanding portion having a different level of fineness or with a surface designed for scruffing, polishing or buffing as the user desires. Once, a new sanding portion 14 is secured to the glove portion 12, the user may continue with the task until completed.

Preferably positioned on an inner side of the glove portion between the palm area 16 and the back hand area 18 is a padded material. The padded material provides a cushion for the hand of the user during the sanding operation. This cushioning of the user's hand will prevent injury or discomfort to the user while also making the task to be performed less burdensome.

From the above description it can be seen that the sanding glove of the present invention is able to overcome the shortcomings of prior art devices by providing a sanding glove which is able to bring precision and perfection to the task of sanding delicate products, while also protecting and releasing tension from the fingers when working and allowing a user to readily sand hard to reach areas of a surface. The sanding glove including a sanding surface releasably secured to the glove portion of the sanding glove which is interchangeable with other surfaces having a different level of coarseness as well as for accomplishing tasks such as a scruffing surface, a polishing surface and a buffing surface. The sanding glove is reusable and washable. The sanding glove also includes a plurality of strategically positioned recesses having rigid walls defining the recess and the sanding surface includes a plurality of protrusions aligned with the plurality of recesses, each of the protrusions being received by a respective recess for securing the sanding surface to the glove portion. Furthermore, the remote video camera of the present invention is simple and easy to use and economical in cost to manufacture.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the sprit of the present invention.

Without further analysis, the following will so fully reveal the gist of the present invention that others can, by applying current knowledge, readily adapt it for various applications without omitting features that, from the standpoint of prior art, fairly constitute essential characteristics of the generic and specific aspects of this invention.

What is claimed is new and desired to be protected by Letters Patent is set forth in the appended claims:

1. A sanding glove comprising:

a) a glove portion for receiving a hand of a user, said glove portion including a palm area and a back hand area secured to said palm area about a periphery thereof;

b) a sanding portion releasably secured to said palm area of said glove portion;

c) means for releasably securing said sanding portion to said palm area whereby when said glove portion receives the hand of the user, the user is able to texture a surface of a n object upon rubbing the sanding portion against the object; and d) said releasably securing means including a plurality of recesses extending through said palm area of said glove portion and a plurality of protrusions extending from a first side of said sanding portion, said plurality of protrusions each being received by a respective one of said plurality of recesses to secure said sanding portion to said glove portion.

2. The sanding glove as recited in claim 1, wherein each of said recesses include a lip portion reducing the circumference thereof and each of said protrusions have an enlarged head portion having a circumference slightly larger than the circumference of its respective recess whereby when said plurality of protrusions are received within their respective recess, the lip portion retains said protrusion therein.

3. The sanding glove as recited in claim 2, wherein each of said recesses are provided with a rigid material defining a depth of said recess.

4. The sanding glove as recited in claim 3, wherein said glove portion includes a cushioning material positioned on a side of said plurality of recesses opposite said sanding portion for cushioning the hand of the user.

5. The sanding glove as recited in claim 1, wherein said glove portion includes an elastic wrist cuff for aiding in retaining the user's hand therein.

6. The sanding glove as recited in claim 1, wherein said glove portion is fabricated from a flexible material for protecting and bending with the hand of the user.

7. The sanding glove as recited in claim 1, wherein said sanding portion includes a semi rigid pad and a sanding area positioned on a side of said semi rigid pad opposite said releasable connection with said glove portion.

8. The sanding glove as recited in claim 7, wherein said sanding portion further includes an adhesive layer for securing said semi rigid pad to said sanding area.

9. The sanding glove as recited in claim 7, wherein said sanding area is one of a sanding material, a buffing material, a scruffing material and a polishing material.

10. The sanding glove as recited in claim 7, wherein said plurality of protrusions extend from a side of said semi rigid pad opposite said sanding area.

11. The sanding glove as recited in claim 1, wherein said sanding portion is shaped to substantially cover the palm area of said glove portion.

12. The sanding glove as recited in claim 1, wherein said palm area and said back hand area have a substantially similar shape.

13. The sanding glove as recited in claim 12, wherein said palm area and said back hand area each include a central section and a plurality of digit sections, said digit sections extending from said central section to form a shape substantially similar to a human hand.

14. The sanding glove as recited in claim 13, wherein said sanding portion is of a shape substantially similar to said glove portion.

15. The sanding glove as recited in claim 1, wherein said glove portion is in the shape of a mitten including a palm section, a thumb section and a finger section.

16. The sanding glove as recited in claim 1, wherein said sanding portion includes one of a sanding material, a buffing material, a scruffing material and a polishing material.

17. The sanding glove as recited in claim 1, wherein said sanding area is a sanding material having a predetermined level of fineness.

18. The sanding glove as recited in claim 1, wherein said glove portion is waterproof.

19. The sanding glove as recited in claim 1, wherein said releasably securing means includes a hook and loop fastener covering said palm area of said glove portion and a hook and loop fastener covering a first side of said sanding portion, said glove portion being aligned with said a first side of said sanding portion for engaging said hook and loop fastener covering said palm area of said glove portion with said hook and loop fastener covering a first side of said sanding portion thereby releasably securing said glove portion and said sanding portion together.

20. The sanding glove as recited in claim 1, wherein said sanding portion includes at least one groove extending along a width thereof for facilitating flexing of the sanding glove by the hand of the user.

21. The sanding glove as recited in claim 1, wherein said sanding portion includes a plurality of grooves extending along a width thereof for facilitating flexing of the sanding glove by the hand of the user.

* * * * *